United States Patent [19]

von Holdt

[11] 4,210,258

[45] Jul. 1, 1980

[54] SEAL FOR PLASTIC BUCKETS AND CANS

[76] Inventor: John W. von Holdt, 7430 N. Croname Rd., Niles, Ill. 60603

[21] Appl. No.: 963,736

[22] Filed: Nov. 27, 1978

Related U.S. Application Data

[63] Continuation-in-part of Ser. No. 882,883, Mar. 2, 1978, abandoned.

[51] Int. Cl.[2] ..... B65D 55/16; B65D 41/18; B65D/43/10

[52] U.S. Cl. ..... 220/306; 220/307; 428/35; 428/133

[58] Field of Search ..... 220/306, 220/307, 353, 355, 356, DIG. 12, DIG. 14, DIG. 27; 428/35,133

[56] References Cited

U.S. PATENT DOCUMENTS

| | | | |
|---|---|---|---|
| 3,583,596 | 6/1971 | Brewer | 220/306 |
| 3,817,420 | 6/1974 | Heisler | 220/307 |
| 3,904,072 | 9/1975 | Whiteside | 220/306 X |
| 3,949,897 | 4/1976 | Shaw et al. | 220/DIG. 27 |
| 3,977,563 | 8/1976 | Holt | 220/355 X |
| 4,027,775 | 6/1977 | Mygatt et al. | 220/306 X |
| 4,046,282 | 9/1977 | Ruch | 220/307 X |
| 4,111,329 | 9/1978 | Lampman | 220/306 X |
| 4,114,849 | 9/1978 | von Holdt | 264/242 X |
| 4,117,950 | 10/1978 | Allen | 220/306 |
| 4,125,246 | 11/1978 | von Holdt | 249/64 X |
| 4,141,463 | 2/1979 | Smith | 220/306 X |
| 4,146,148 | 3/1979 | Dwinnell et al. | 220/307 X |
| 4,151,929 | 5/1979 | Sapien | 220/307 X |
| 4,165,020 | 8/1979 | Hoselton | 220/306 |

*Primary Examiner*—Harold Ansher

*Attorney, Agent, or Firm*—Charles F. Pigott, Jr.

[57] ABSTRACT

A plastic bucket lid is adapted for removable attachment adjacent its periphery to a bucket. The lid defines an annular open depression adjacent its periphery, and, positioned outwardly from the depression, an annular locking slot for receiving and holding the lip of a bucket. In accordance with this invention, radially-positioned reinforcing fins are carried by the lid within the annular, open depression to restrict the flexing of its outer wall. This, in turn, has been found to reduce the tendency of the lid to be knocked off of a bucket upon being dropped or the like. Preferably, an outwardly positioned annular projection is placed in the locking slot which defines an angle of 80° to 100° to the plane of the annular walls defining the locking slot for improved retention of the lid to the bucket.

19 Claims, 22 Drawing Figures

FIG. 12
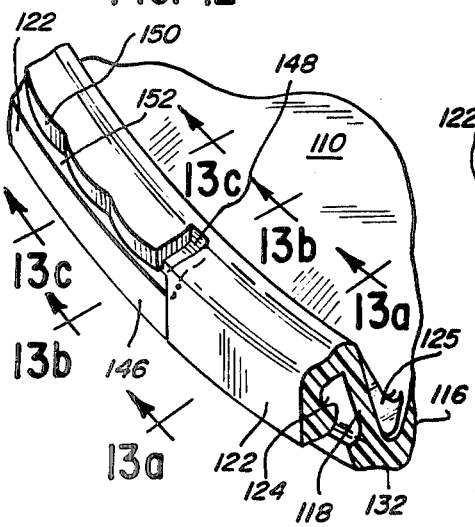
FIG. 11
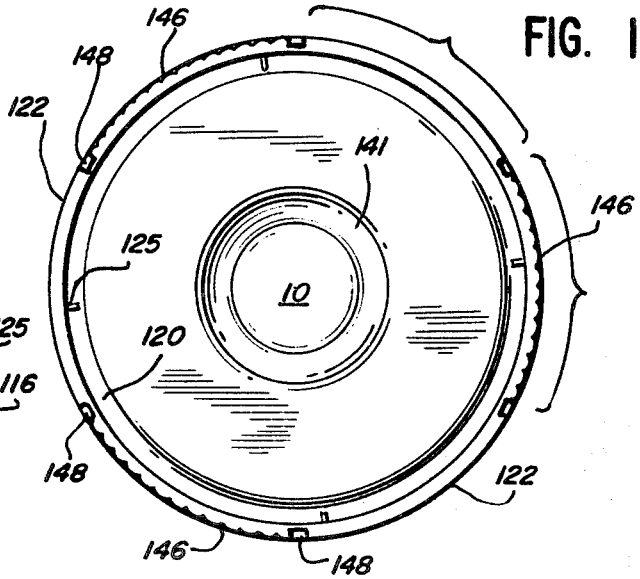
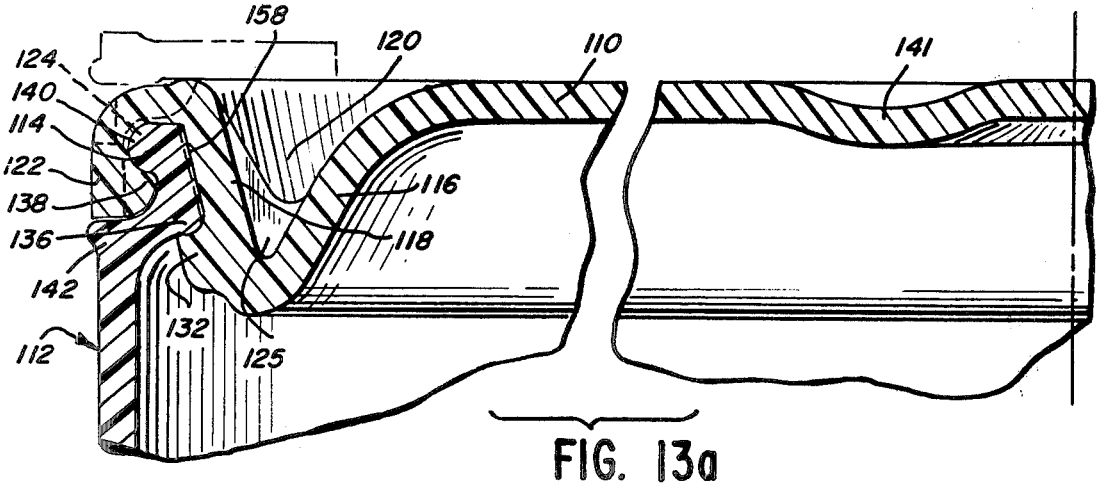
FIG. 13a
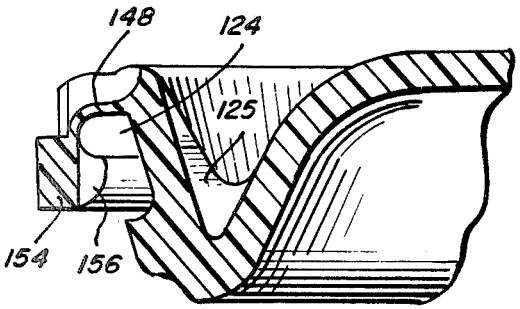
FIG. 13b
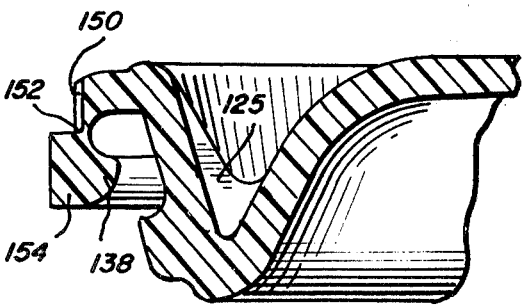
FIG. 13c FIG. 14
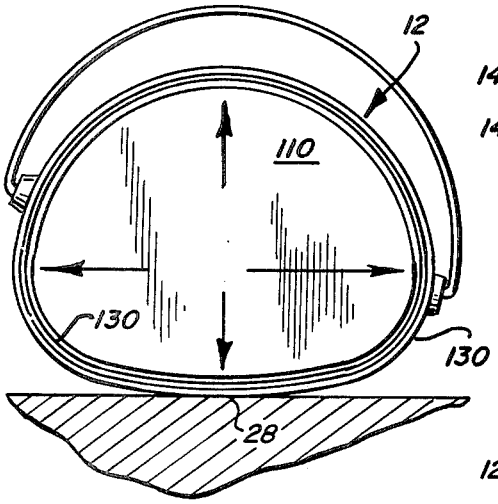
FIG. 16
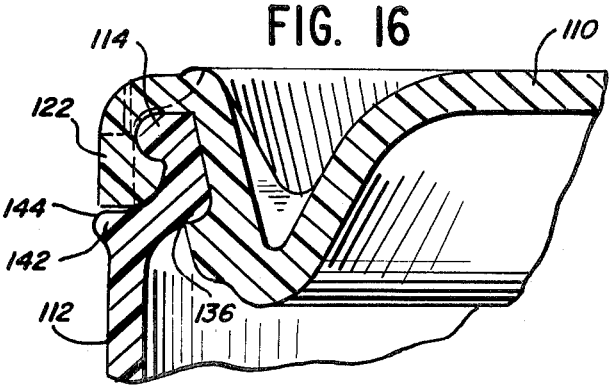
FIG. 17
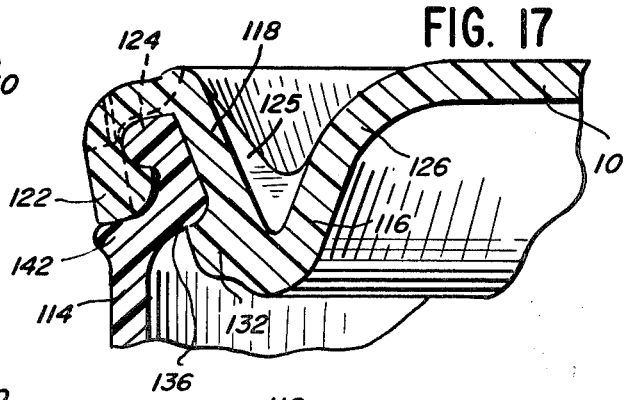
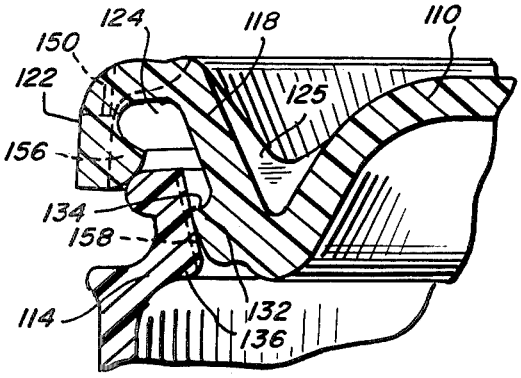
FIG. 15
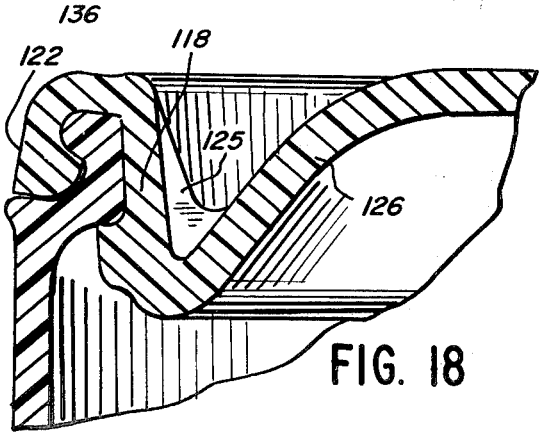
FIG. 18
FIG. 19
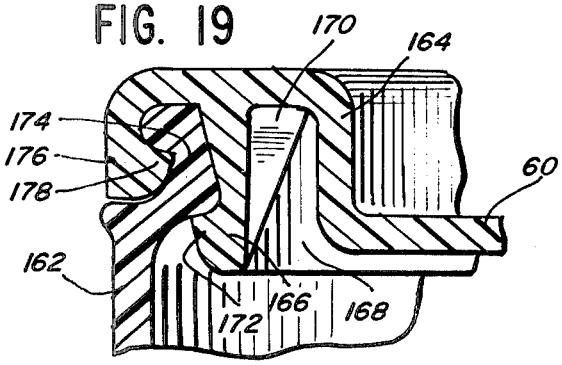
FIG. 20
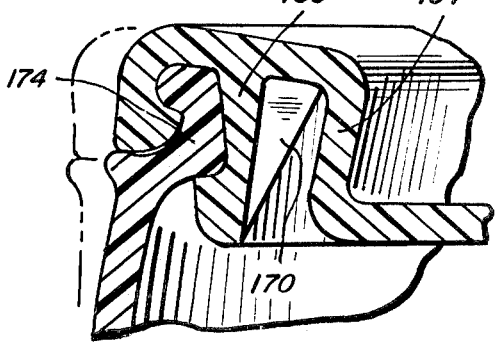

SEAL FOR PLASTIC BUCKETS AND CANS

CROSS-REFERENCE TO RELATED APPLICATION

This application is a continuation-in-part of patent application Ser. No. 882,883, filed Mar. 2, 1978 now abandoned.

BACKGROUND OF THE INVENTION

This application relates to an improved lid-type seal for cans and buckets, particularly large plastic cans and buckets.

Currently, paint buckets are generally made of steel. One reason for this is that it has not been previously possible to economically manufacture a large bucket made of plastic, which can be sealed with a paint can-type lid in which the lid firmly remains on the bucket until it is pried off. For example, paint buckets should be able to stand at least a four-foot drop on its mouth edge without losing the lid and spilling the paint.

The conventional configuration of a paint can seal, when molded in plastic, is generally inadequate for this rigorous requirement.

Accordingly, plastic paint buckets and other containers have been proposed in which a rubber sealing ring is provided to prevent leakage, but cost factors have made this arrangement relatively non-competitive.

In accordance with this invention, a seal structure between a plastic bucket and lid is provided which shows greatly improved resistance to opening by flexing wall action of the bucket mouth inwardly or outwardly, as would take place where a full paint bucket drops upon its rim. This is accomplished by providing, in addition to the usual rim seal in which the periphery of the lid grips from the outside an annular portion of the bucket rim, an added internal lid seal for gripping action internally of the annular portion of the bucket rim. Accordingly, this double seal holds even in the presence of substantial shock and flexing applied laterally to the bucket rim, but at the same time the lid can be peeled off with a screwdriver or the like in a manner analogous to the conventional opening of a paint bucket.

Also, radially positioned reinforcing ribs are provided for selective rigidity in the plastic bucket lid, which greatly improves the retentiveness of the lid under conditions of stress.

Heisler U.S. Pat. No. 3,817,420 discloses a bucket and lid connection arrangement having an internal seal, in which the bucket rim is a non-standard, double-walled structure. This exhibits significant disadvantage because of the need of the paint bucket industry for paint buckets of essentially conventional shape, capable of passing through the present filling machinery and the like.

DESCRIPTION OF THE INVENTION

In accordance with this invention, a plastic bucket lid may be provided to be removably attachable adjacent its periphery to a bucket. The lid may preferably define first and second annular wall means forming an annular, open depression adjacent its periphery. The second annular wall means defines the outer limit of the depression, while the first annular wall means defines the inner limit of the depression. The lid also defines third annular wall means, positioned outwardly from the second wall, with the second and third annular wall means defining an annular locking slot for receiving and holding the lip of a bucket. The third annular wall means may define inwardly extending projection means for interlocking with a corresponding projection on the bucket lip.

In accordance with this invention, radially positioned reinforcing fins may be carried by said lid within the annular, open depression to restrict flexing of the second wall.

Also, the bucket lip may define a single wall free of overlapping wall sections. The second, annular wall of the lid may define an outwardly extending projection, which projection defines a surface which faces the annular locking slot and defines an angle of 80° to 100° to the plane of the second wall. The bucket lip, in turn, defines a projection adapted for interlocking, retaining relation with the outwardly extending projection of the second wall of the lid, which provides retention of the bucket lip within the locking slot with improved strength.

Because of the fact that the second wall, which defines the outer portion of the open depression and the inner portion of the locking slot, is restricted in its flexing by the fins, the stability of the locked connection between the bucket lip and the lid is greatly increased, with the necessary flexing taking place at a position other than the area of the locking slot, as illustrated below.

Preferably, the radially positioned reinforcing fins extend in contact with a greater portion of the height of the second wall than the first wall. This permits necessary flexing, which may take place upon the bucket being dropped, inwardly from the area of the locking slot while preventing flexing at the locking slot. Preferably, the radially positioned reinforcing fins extend in contact with essentially the entire height of the second wall, but no more than half the height of the first wall.

It is generally preferred for the above described features of this invention to be used together, i.e., the combination of the radial fins with the outwardly positioned annular projection on the inner surface of the locking slot having a surface which defines an angle of 80° to 100° to the plane of the inner wall of the locking slot, and preferably perpendicular (90°) thereto.

It is also often desirable for tear means to be provided for ripping away segments of the third wall prior to removing the bucket lid from the bucket. This naturally reduces the gripping strength of the bucket lid to the bucket, and makes removal easier. However, the bucket lid still remains firmly grippable to the bucket for temporary closing and on-the-job use.

Air vent means are also preferably defined between the bucket lip and the second wall to facilitate the installation of the lid on the bucket without forming pockets of compressed air.

Accordingly, the bucket lid seal utilized in this invention provides the advantages described above, particularly the use of semi-flexible plastic materials, such as polyethylene or polypropylene, for making large buckets and cans, for example of the general design of a paint bucket, in which a tight seal is provided even though the plastic material used is resilient, and thus capable of more flexing than the previous metal buckets.

Referring to the drawings,

FIG. 11 is a plan view of a bucket lid in accordance with this invention attached to a bucket.

FIG. 12 is a fragmentary, detailed perspective view, with portions broken away, of the bucket lid of this invention.

FIG. 13*a* is an enlarged fragmentary vertical sectional view of a bucket and lid in accordance with this invention, taken along line 13*a*—13*a* of FIG. 12.

FIG. 13*b* is a fragmentary sectional view taken along 13*b*—13*b* of FIG. 12.

FIG. 13*c* is a fragmentary sectional view taken along line 13*c*—13*c* of FIG. 12.

FIG. 14 is an elevational view of a bucket and lid in accordance with this invention, filled with paint or the like, striking the floor after being dropped and flexing in a manner which tends in a prior art configurations to cause the lid to pop off.

FIG. 15 is a fragmentary sectional view of the lip of the bucket and periphery of the lid of this invention in the process of being locked together in sealing relation.

FIG. 16 is a fragmentary vertical sectional view of the bucket lip and lid of this invention installed in sealing relation.

FIG. 17 is a fragmentary sectional view of the bucket and lid of FIG. 16 at a point where the periphery of the bucket lip is being flexed outwardly upon being dropped.

FIG. 18 is a fragmentary sectional view of the bucket and lid of FIG. 16 at a point where the lip and lid are being flexed inwardly upon being dropped.

FIG. 19 is a fragmentary sectional view of another embodiment of the bucket and lid of this invention adapted for generally permanent emplacement.

FIG. 20 is a fragmentary sectional view, similar to FIG. 19, showing the bucket lid and lip portion being stressed inwardly by being dropped or the like.

Figure 2:
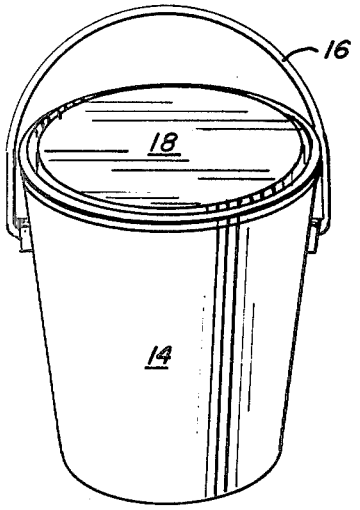
FIG. 2 is a perspective view of another plastic paint bucket and separable lid of a slightly different design, using the invention of this application.
Figure 1:
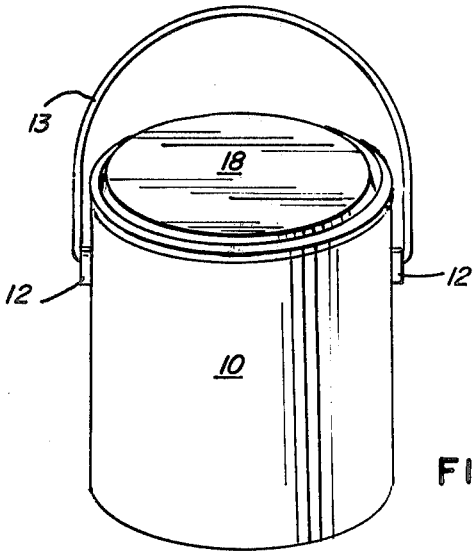
FIG. 1 is a perspective view of a plastic paint bucket and separable lid utilizing the invention of this application.
Figure 3:
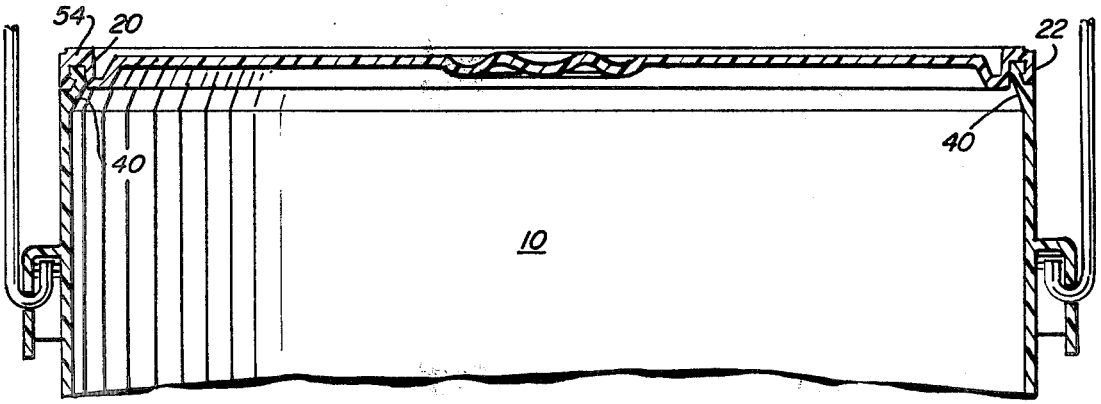
FIG. 3 is a vertical sectional view of the paint bucket and lid of FIG. 1.

Referring to the drawings, FIGS. 1 and 2 are perspective views of different embodiments of paint buckets utilizing a closure of this invention. Bucket 10 is shown to be a straight-sided bucket, i.e., cylindrical in shape, which has the advantage that it can be molded from plastic to the size and general shape of the present paint buckets, and thus can be processed by paint companies in the filling equipment already in existence.

Bucket 10 is shown to carry a pair of bail attachment members 12 into which a wire bail 13 is inserted, although, if desired, other plastic bucket handles and bails may be integrally molded with the bucket itself in accordance with the disclosures of my U.S. application Nos. 805,739, filed June 13, 1977 now U.S. Pat. No. 4,125,246, and No. 781,631, filed Mar. 28, 1977 now U.S. Pat. No. 4,114,849.

FIG. 2 is a perspective view of another type of bucket 14 which may use the invention of this application, having tapered sides which permits the stacking of the buckets before use. Bucket 14 also carries a bail or handle 16 of any desired design.

Turning to FIGS. 3 through 7, bucket 10 is shown in conjunction with bucket lid 18, which may be a relatively flat, plastic piece generally circular in shape and of a cross section as indicated. Similar structure may be found in bucket 14.

Figure 4:
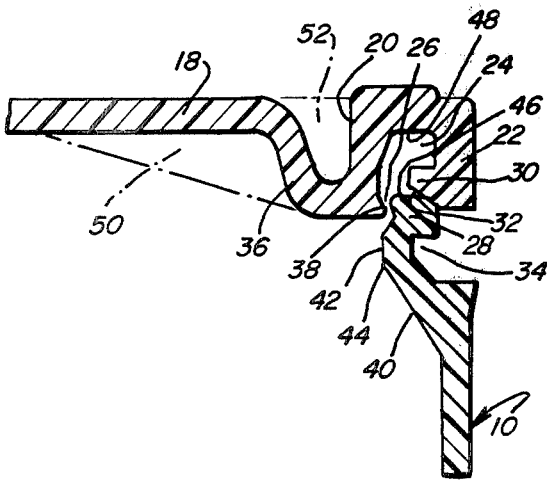
FIG. 4 is an enlarged sectional detail view, similar to FIG. 3, prior to emplacement of the lid of this invention on the paint bucket.

Lid 18 defines, at its periphery, an annular, inner wall 20 and an annular outer wall 22 which are spaced from each other to form an annular groove 24, defining an open mouth 26 for receiving the lip 28 of bucket 10 as shown, for example, in FIG. 4.

Figure 5:
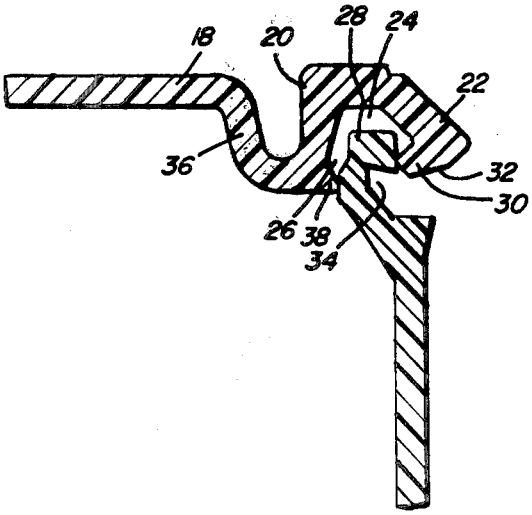
FIG. 5 is an enlarged sectional detail view similar to FIG. 3, showing the lid of this invention in the process of being emplaced on the bucket of FIG. 3.

Lid 18 further defines a first, peripherally positioned annular flange 30 which extends radially inwardly to the groove 24 from the outer wall, adjacent mouth 26 of the groove. Accordingly, as lid 18 is pressed onto the rim of bucket 10, outer wall 22 is biased outwardly by the camming action of lip 28 of bucket 10 against the tapered surface 32, positioned on the lower end of outer wall 22, as shown in FIG. 5, until flange 30 clears the lip 28 of the bucket and snaps into annular recess 34 of the bucket, which is defined below lip 28, for a snap-fit seal.

During the same action, innermost wall segment 36 of the lid may transiently bend inwardly during the same snap-fit operation, to momentarily widen mouth 26 for receiving the lip 28 of bucket 10.

Also, lid 18 defines a second annular flange 38 which extends radially outwardly into groove 24, adjacent mouth 26, from inner wall 20, for improved retention of lid 18 on the bucket.

Figure 6:
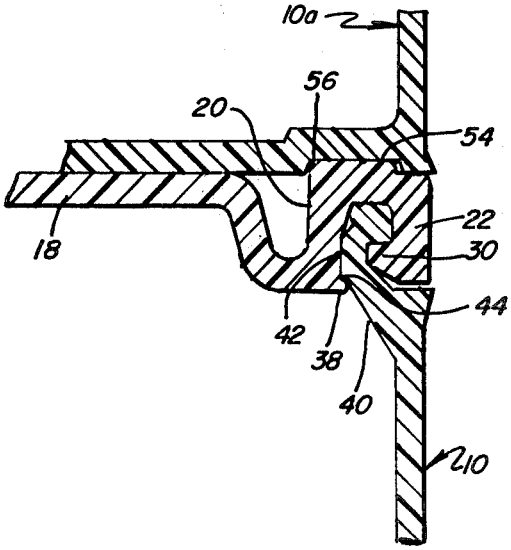
FIG. 6 is an enlarged sectional detail view similar to FIG. 3, showing the lid emplaced on the bucket rim, and showing a stacked bucket.

Bucket 10, in turn, defines an inwardly sloping inner wall portion 40 of annular shape, terminated by a straight portion 42 of the inner wall which does not slope inwardly adjacent lip 28, to define a wall angle 44 of annular shape. This, as shown in FIG. 6, is engaged by second annular flange 38 when lid 18 is secured on the bucket. The result of this is to provide both an interior and an exterior seal with respect to the bucket rim that provides greatly improved resistance to popping off, when the rim of the bucket is struck so as to be deflected inwardly.

Also, sloping surface 40 and top surface 46 of the bucket lip engage respectively against the upper surface of flange 38 and the underside 48 of lid 18 to provide a pair of seal areas, to prevent leakage of the container contents. Preferably sealing surfaces 40, 42, 46, 48 and the upper surface of flange 38 are smooth, and free of parting lines for an improved seal. This may be accomplished by molding the bucket in a non-collapsible core, and then pneumatically removing it by blowing compressed air through the core. The inner surface 42 acts as a spring seal about the core, to retain the compressed air until the mold has been removed from the core. This avoids the formation of parting lines on the above surfaces.

If desired, various radially positioned stiffening ribs 50, 52 may be provided at locations where desired in lid 18, to stiffen lid 18, especially near its periphery. Ribs 50, 52 may be molded wall portions, positioned radially about lid 18 in any pattern desired.

FIG. 6 shows how bucket 10 and lid 18 may be shaped to permit stacking of identical buckets 10, 10*a* one on top of each other. As shown, a portion of the bottom of identical bucket 10*a* is conformed to fit on the upper surface of lid 18, in which an annular projection 54 of lid 18 fits into corresponding annular groove 56 in the bottom of bucket 10*a*, to reduce the possibility of lateral slippage of the stack of buckets.

Figure 7:
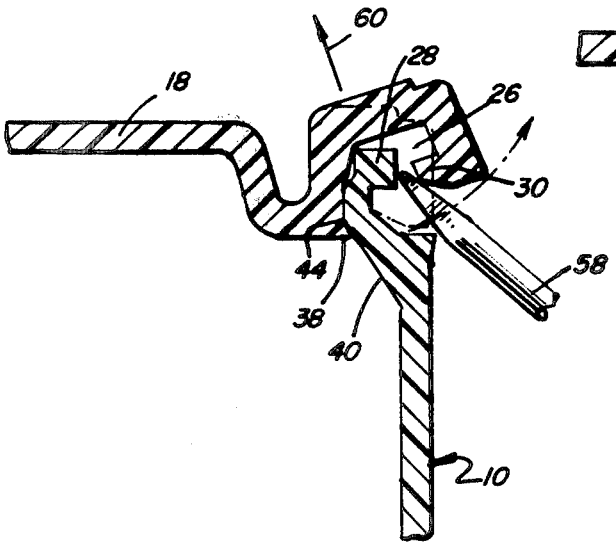
FIG. 7 is an enlarged sectional detail view similar to FIG. 3, showing the lid being removed from the bucket.

FIG. 7 shows how the lid 18 may be removed from the bucket 10 of this invention. A screwdriver or similar pointed object 58 is inserted laterally underneath flange 30 of the lid, which is then pried upwardly, causing disengagement of flange 30 and lip 28 of the bucket. Accordingly, lid 18, being preferably made of a semi-flexible plastic such as polyethylene, can be peeled off of the top of the bucket by pulling the disengaged portion of the lid backwardly in the general direction of arrow 60.

Figure 8:
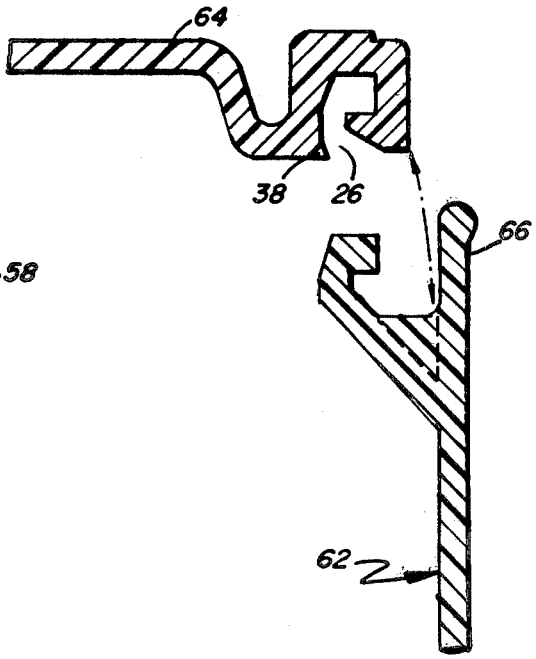
FIG. 8 is an enlarged sectional detail view similar to FIG. 3, but showing details of a different embodiment of the seal arrangement.

FIG. 8 shows an alternate design of a container and lid system, in which lid 64 is generally similar in construction to lid 18. Container 62 is similar in structure to container 10, except that a protective, outer, annular flange 66 is provided to reduce the possibility of disengagement of lid 64 from the top of the bucket 62.

Figure 9:
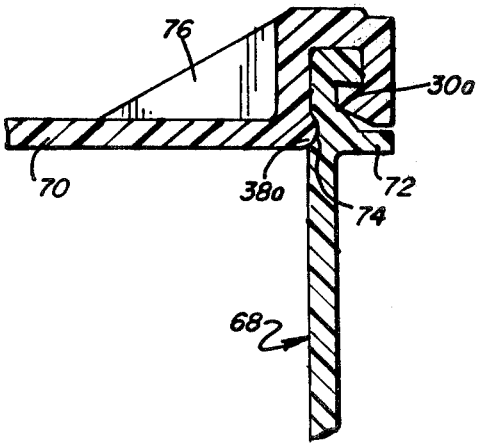
FIG. 9 is an enlarged sectional, detail view, similar to FIG. 3, showing yet another alternate embodiment of the seal construction.

FIG. 9 shows yet another design of a bucket 68 and lid 70. In this instance, bucket 68 defines a radially outwardly projecting platform 72 underneath the inwardly projecting flange 30*a*, which corresponds to flange 30 of lid 18.

The outwardly projecting annular flange 38*a* generally corresponds in function to flange 38 of the previous embodiments. However, flange 38*a* is seen to be more rounded, and fits into an inner facing annular recess 74 defined in bucket 68, and proportioned to receive flange 38*a* in a snap-fit relationship.

Also, lid 70 defines a plurality of radial veins 76, which are positioned about the circumference of lid 70. For example, four veins 76 may be used, spaced 90° apart from each other, for general stiffening of the lid 70. Alternatively, any other desired number of radial veins may be used as may become necessary in any individual situation. Veins 76, as well as optional veins 50 and 52 discussed above, may comprise relatively thin walls, seen in elevation in the drawings, for the purpose of reducing to any degree desired the flexibility of the plastic lid on which they are carried, particularly adjacent the periphery of the lid.

Figure 10:
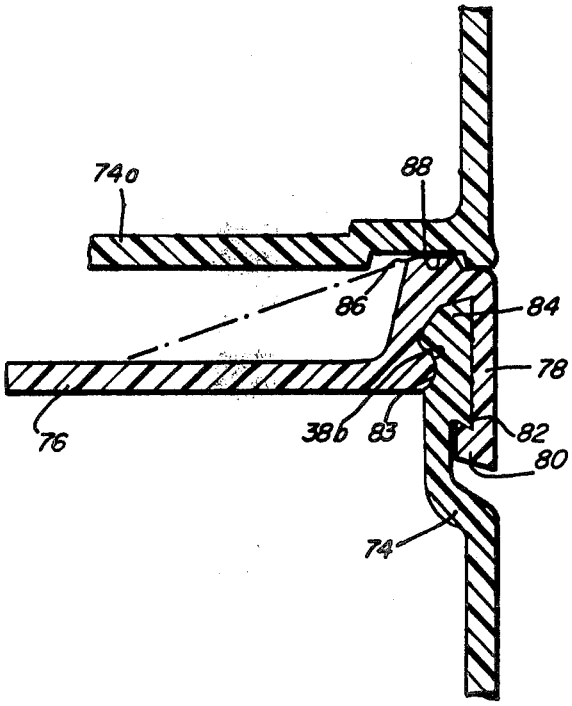
FIG. 10 is an enlarged, sectional detail view, similar to FIG. 3, showing yet another alternative embodiment of the seal construction.

Another modification of a bucket 74 and a lid 76 is disclosed in FIG. 10. In this instance, lid 76 defines an annular, depending flange 78 positioned about its periphery and terminating into the first peripherally positioned, inwardly extending annular flange 80 corresponding to the analogous flanges of the previous embodiment, but with peripheral flange 78 being elongated. Inwardly extending flange 80 is adapted for a snap-fit engagement with annular step 82 defined on bucket 74 for outward retention of the lid on the bucket in a manner analogous to the previous embodiments.

Outwardly projecting annular flange 38*b* of bucket lid 76 is similar in structure and function to member 38*a* of the embodiment of FIG. 9, and is adapted to fit into annular recess 83 defined on the inner surface of the bucket adjacent to annular lip 84 thereof.

Accordingly, the same double seal relationship between the bucket lip and the lid is provided as in the previous embodiment.

Also, a portion of the bottom of second bucket 74*a* is shown standing on top of bucket 74. As in the previous embodiments, annular enlargement 86 of lid 76 fits in annular recess 88 of the bucket bottom to provide stability to the buckets as they are stacked.

Referring to FIGS. 12 through 18, a preferred embodiment of a paint bucket lid is shown. Lid 110 is shown, for example, in FIG. 13*a*, to be removably attached adjacent to its periphery to a bucket 112, which defines a lip 114.

Lid 110 defines first annular wall 116 and second annular wall 118, which cooperate to define an annular, open depression 120 adjacent the periphery of lid 110, with the second annular wall 118 defining the outer limit of the depression and the first annular wall 116 defining the inner limit of the depression.

Lid 110 also defines a third annular wall 122, positioned outwardly from second wall 118 in such manner that the second annular wall 118 and the third annular wall 122 define an annular locking slot 124 for receiving and holding lid 114 of the bucket.

In accordance with this invention, radially-positioned reinforcing fins 125 are provided within the annular, open depression 120 for the purpose of restricting the flexing of second wall 118. As can be seen from FIG. 13*a*, the radially-positioned reinforcing fins 125 extend in contact with a greater portion of the height of second wall 118 than the height of first wall 116. Specifically, the reinforcing fins 125 extend in contact with essentially the entire height of the second wall 118, about one fourth to one half the height of first wall 116.

As a result of this, fins 125 cause annular wall 118 to remain generally rigid during flexing and stress, as is illustrated in FIGS. 17 and 18, with the pivoting action being focused about the upper portion 126 of first wall 116.

A typical source of the flexing which is illustrated in FIGS. 17 and 18 is shown in FIG. 14, which is a side view of a paint bucket and lid at the moment of impact with the ground after falling. As shown therein, the lower side 128 of bucket 112 and lid 110 is collapsed in the manner shown sectionally in FIG. 18, because of the impact with the ground. Simultaneously, due to the outward internal pressures from the contents of the paint bucket and lid, sides 130 are stressed outwardly in the manner illustrated in FIG. 17. Because of the rigidity of wall 118 provided by reinforcing fins 125, the entire system of walls 118 and 122, plus locking slot 124, remains relatively uneffected by the stress, with the great majority of the necessary flexing of the lid 110 taking place at area 126 of the first wall 116.

Typically, four to eight radially positioned reinforcing fins 125 may be spaced equidistantly within annular depression 120, although greater or fewer numbers of the fins 125 may be utilized as may be specifically desired for a given circumstance.

Second wall 118 of the lid 110 also carries an outwardly positioned, annular projection 132 defining a surface 134, (FIG. 15) which faces the annular locking slot 124 and which defines an angle of about 80° to 100° to the plane of second annular wall 118. Specifically, face 134 may have a segment which is perpendicular to the plane of wall 118.

Projection 132 is proportioned to contact and retain a mating projection 136 of bucket lip 114 positioned within the locking slot as shown in FIGS. 13*a* and 16. As shown in FIGS. 17 and 18, the entire locked arrangement of bucket 114 and locking slot 124 is firmly retained in its locked arrangement, despite the stresses provided by dropping a paint bucket or the like.

The essentially perpendicular relationship of face 134 provides firm retention of the bucket lip within the locking slot.

Third annular wall 122 defines an inwardly positioned projection 138, adapted to interlock with an outwardly facing projection 140 of the bucket lip positioned within the locking slot.

Accordingly, an extremely tight and firm seal is provided in accordance with this invention between bucket lid 110 and the bucket 112.

Annular projection 142 may also be provided on the exterior of the bucket below the overhanging outer wall 122 of the lid. This prevents the excessive outward bending of the bucket, since, as shown in FIG. 17, in the event of such outward bending the bottom of wall 122 presses against projection 142, serving as an additional reinforcement to limit flexing.

When it is desired to remove the lid 110 from the bucket 112, one can insert a screwdriver or the like in the space between outer wall 122 of the lid and annular projection 142, to pry wall 122 outwardly and thus to peel off the generally flexible bucket lid.

However, in the event that the seal between lid 110 and bucket 112 is so strong that it is difficult to remove the lid even with a screwdriver, tear means may be provided as shown for ripping away segments of third wall 122 prior to removing the bucket lid from the bucket.

Removable segments 146 of third wall 122 are generally illustrated in FIG. 11. After the segments 146 have been removed, lid 110 may be more easily removed from the bucket, while a firm seal is still provided for sealing of the bucket after opening, for example, on a painting job or the like.

As shown in FIGS. 13*a* through 13*c*, which are sectional views of FIG. 12, FIG. 13*a* shows a view through a non-removable portion of wall 122.

Lid 110 carries a thinned slot 148, defining a thin web of plastic material at its bottom as shown in FIG. 13*b*.

Corrugation ring 141 on lid 110 also assists in receiving and damping the internal forces of a dropped bucket against the top of lid 110.

The cross-sectional view of segments 146 themselves is shown in FIGS. 12 and 13*c*, in which a serrated portion 150 is defined, exposing a thin, frangible web portion 152 of the plastic material. Accordingly, to open the container of this invention by removing portions 146, one inserts a screwdriver, knife, or the like into slot 148 to sever the thinned bottom thereof. One then tears lower portion 154 of wall 122 away from the remainder of lid 110 by ripping it from slot 148 along thinned line 152 to the next slot 148, for removal of portion 146. Large segments of the annular projection 138 are removed by this action.

Spaces 156 are provided between the segments of annular projections 138 to facilitate their removal, as shown in FIG. 13*b*.

One or more grooves 158 are provided on the inner face of lip 114, to facilitate the removal of air as lid 110 is sealed to bucket 112.

FIG. 15 shows how outer third wall 122 can flex outwardly as the lid 110 is placed upon the bucket lip. The functioning of grooves or vents 158 is also illustrated, showing how air can be bled out of the otherwise-sealed locking slot 124 until projection 132 comes into locking engagement with projections 136.

Accordingly, a paint bucket with a flexible plastic lid is provided, which nevertheless exhibits an extremely tight and reliable seal, with the typical sealing points being between annular projections 132 and 136, and the top of lip 114 of the bucket, where it bears against the undersurface of locking slot 124. This flexible bucket lid may be equipped as desired with tear strips 146 in any pattern and relative length, for removal after shipping of the bucket to its point of use to make the opening of the bucket easier. Alternatively, no tear strips need to be used.

The bucket of this invention may be designed to be processable in the present commercial filling and sealing machinery for metal paint buckets, while also exhibiting substantial cost reduction and shipping weight along with its high reliability.

Referring to FIGS. 19 and 20, a modification of the invention of this application is shown. Specifically, a generally permanent attachment of a bucket lid 160 to a bucket 162 is illustrated. The bucket lid defines the first annular wall 164 and second annular wall 166 in a manner generally similar to the preceding embodiment, but defining an open depression 168 which faces in the opposite direction. Radially positioned reinforcing fins 170 are provided in a manner similar to the previous case, plus outwardly extending projection 172 on the second wall 166, which preferably defines a surface of 80° to 100° to the plane of wall 166, and preferably is perpendicular thereto.

Bucket lip 174 is generally similar in design to the bucket lip shown in the previous embodiment, while outer wall 176, generally free of tear strips, defines an inwardly-facing projection 178 similar to the previous embodiment.

As shown in FIG. 20, stressing of the bucket of this invention causes flexing along inner wall 164, while second wall 166 remains rigid. Accordingly, the connection between bucket lip 174 and the lid remains intact, so that the bucket can remain sealed under very heavy internal and external flexing stresses.

In this invention, it is contemplated that a spout or the like will be provided in lid 160 for access to the contents.

The above has been offered for illustrative purposes only and is not intended to limit the invention of this application, which is as defined in the claims below.

That which is claimed is:

1. A plastic bucket lid adapted for removable attachment adjacent its periphery to a bucket, said lid defining first and second annular walls forming an annular, open depression adjacent its periphery, said second annular wall defining the outer limit of said depression and the first annular wall defining the inner limit of said depression, said lid also defining a third annular wall, positioned outwardly from said second wall, said second and third annular walls, in turn, defining an annular locking slot for receiving and holding the lip of a bucket, the improvement comprising, in combination:

radially positioned reinforcing fins carried by said lid within the annular, open depression, to restrict the flexing of said second wall, said fins extending in contact with a greater portion of the height of the second wall than the first wall.

2. The plastic bucket lid of claim 1 in which said radially positioned reinforcing fins extend in contact with essentially the entire height of said second wall and no more than half the height of said first wall.

3. A plastic bucket lid adapted for removable attachment adjacent its periphery to a bucket, said lid defining first and second annular walls forming an annular, open depression adjacent its periphery, said lid also defining a third annular wall positioned outwardly from said second wall, with said second annular wall defining the outer limit of said depression and the first annular wall defining the inner limit of said depression, said second and third annular walls, in turn, defining an annular locking slot for receiving and holding the lid of a bucket, said third annular wall defining inwardly-positioned projection means adapted to interlock with an outwardly-facing projection of a bucket lip positioned within the locking slot, the improvement comprising, in combination:

radially positioned reinforcing the fins carried by the lid within the annular open depression, to restrict the flexing of said second wall, the fins extending in contact with a greater portion of the height of the second wall than the first wall, said second wall also carrying an outwardly-positioned annular projection defining a surface which faces the annular locking slot and which defines an angle of 80° to 100° to the plane of said second annular wall, said projection being proportioned to contact and retain a mating projection of a bucket lip positioned within the locking slot, whereby, upon flexing of a bucket and attached lid by being dropped, more flexing occurs in said first wall than said second wall, and said outwardly extending projection on the second wall continues to retain said bucket lip within the locking slot.

4. The plastic bucket and lid of claim 3 in which said projection of the second wall defines a surface having an angle of 90° to the plane of said second wall.

5. The plastic bucket lid of claim 3 in combination with a plastic bucket defining an annular lip which is positioned within said annular locking slot, said annular lip further defining an inwardly-extending projection positioned in engagement with said projection of the second wall, a first outwardly extending projection on said bucket lip positioned in interlocking relationship with the inwardly extending projection of the third wall, and a second outwardly extending projection adjacent said bucket lip positioned immediately below said third wall, whereby outward flexing of said bucket lip is restricted by impaction of the bottom of the third wall against the second outwardly facing projection.

6. The plastic bucket and lid of claim 5 in which tear means are provided for ripping away segments of said third wall prior to removing said bucket lid from the bucket.

7. The plastic bucket and lid of claim 6 in which air vent means are defined between said bucket lip and locking slot.

8. The plastic bucket and lid of claim 7 in which said projection of the second wall defines a surface having an angle of 90° to the plane of said second wall.

9. A plastic bucket lid removably attached adjacent its periphery to a bucket having a lip, said lid defining inner and outer annular wall means defining an annular locking slot for receiving and holding said lip of the bucket, the outer annular wall means defining an inwardly-extending projection for interlocking with a corresponding projection on said bucket lip, the improvement comprising, in combination:

said bucket lip defining a single wall, free of overlapping wall sections, said inner wall of the lid defining an outwardly-extending projection, said projection defining a surface which faces the annular locking slot and defines an angle of 80° to 100° to the plane of said inner wall, said bucket lip defining projection means adapted for interlocking, retaining relation with said outwardly-extending projection for strong retention of the bucket lip within said locking slot, said bucket lid defining within said inner annular wall means a generally flexible wall portion sealingly occluding the area within said annular inner wall means, said generally flexible wall portion defining an annular innermost wall member spaced from said inner wall means and transversely positioned relative to the overall plane of the lid, and adaped to flex to a degree greater than said inner wall member upon dropping of the bucket and the like, to prevent disengagement of the lid from the bucket.

10. The plastic bucket and lid of claim 9 in which tear means are provided for ripping away segments of said outer wall prior to removing the installed bucket lid from its bucket.

11. The bucket and lid of claim 9 in which the angle of said facing surface to the inner wall is essentially 90°.

12. The bucket and lid of claim 1 in which air vent means are defined between said bucket lip and locking slot.

13. A plastic bucket lid adapted for removable attachment adjacent its periphery to a bucket, said lid defining first and second annular walls forming an annular, open depression adjacent its periphery, said second annular wall defining the outer limit of said depression and defining a transversely extending wall portion connected only at one side to the remainder of said plastic bucket lid, said first annular wall defining the inner limit of said depression and constituting an integral segment of the bucket lid, being connected at opposed sides to other portions of the bucket lid, and a third annular wall positioned outwardly from said second wall, said second and third annular walls, in turn, defining an annular locking slot for receiving and holding the lip of a bucket, said second wall also carrying an outwardly positioned annular projection defining a surface which faces the annular locking slot and which defines an angle of 80° to 100° to the plane of said second annular wall, said projection being proportioned to contact and retain a mating projection of a bucket lip positioned within the locking slot, said third annular wall defining an inwardly positioned projection adapted to interlock with an outwardly-facing projection of a bucket lip positioned within the locking slot, whereby, upon flexing of a bucket and attached lid by being dropped, more flexing occurs in the first wall than in the second wall, and said outwardly extending projection on the second wall continues to retain said bucket lip within said locking slot.

14. The lid of claim 13 in which said projection of the second wall defines a surface having an angle of 90° to the plane of said second wall.

15. The plastic bucket lid of claim 13 in which air vent means are defined between said bucket lip and locking slot to facilitate insertion of the bucket lid into the slot.

16. The plastic bucket and lid of claim 13 in which tear means are provided for ripping away segments of said third wall prior to removing said bucket lid from the bucket.

17. The plastic bucket lid of claim 13, in combination with a plastic bucket defining an annular lip which is positioned within said annular locking slot, said annular lip further defining an inwardly-extending projection positioned in engagement with said outwardly positioned projection of the second wall, a first outwardly-extending projection on said bucket lip positioned in interlocking relationship with the inwardly-extending projection of the third wall, and a second outwardly-extending projection adjacent said bucket lip positioned immediately below said third wall, whereby outward flexing of said bucket lip is restricted by impaction of the bottom of the third wall against the second outwardly-facing projection.

18. The plastic bucket lid of claim 13 in which radially positioned reinforcing fins are carried by said lid within the annular recess to restrict the flexing of said second wall, said reinforcing fins extending in contact with a greater portion of the height of the second wall than the first wall.

19. The plastic bucket lid of claim 18 in which said radially positioned reinforcing fins extend in contact with essentially the entire height of said second wall and no more than half the height of said first wall.

* * * * *